US006711979B1

(12) United States Patent
Miyakawa et al.

(10) Patent No.: US 6,711,979 B1
(45) Date of Patent: Mar. 30, 2004

(54) CUTTING METHOD OF CERAMIC HONEYCOMB FORMED BODY

(75) Inventors: Takashi Miyakawa, Nagoya (JP); Yuji Ueda, Nagoya (JP); Satoshi Sugiyama, Nagoya (JP)

(73) Assignee: NGK Insulators, Ltd. (JP)

( * ) Notice: Subject to any disclaimer, the term of this patent is extended or adjusted under 35 U.S.C. 154(b) by 0 days.

(21) Appl. No.: 09/787,842

(22) PCT Filed: Jul. 24, 2000

(86) PCT No.: PCT/JP00/04905

§ 371 (c)(1),
(2), (4) Date: Jun. 7, 2001

(87) PCT Pub. No.: WO01/07224

PCT Pub. Date: Feb. 1, 2001

(30) Foreign Application Priority Data

Jul. 26, 1999 (JP) ..... 11/210693
Jul. 3, 2000 (JP) ..... 2000/201229

(51) Int. Cl.[7] ..... B28B 11/14; B26D 1/547
(52) U.S. Cl. ..... 83/862; 83/785
(58) Field of Search ..... 83/785, 870, 651.1, 83/862, 875, 879, 881, 880, 876, 54; 451/6; 125/21, 16 R, 16.02; 366/336; 144/312, 309 R

(56) References Cited

U.S. PATENT DOCUMENTS 4,108,029 A * 8/1978 Borzym ..... 83/54
4,484,502 A 11/1984 Ebner
4,494,523 A 1/1985 Wells
4,528,883 A 7/1985 Goransson et al.
4,624,168 A * 11/1986 Borzym ..... 83/862
4,702,138 A 10/1987 Hattori et al.
5,890,481 A 4/1999 Bigelow
6,006,737 A 12/1999 Hayashi et al.

FOREIGN PATENT DOCUMENTS

JP 56-129113 10/1981
JP 61-132302 6/1986
JP 61-189907 8/1986
JP 63-67105 3/1988
JP 10-34639 2/1998
JP 2000141347 * 5/2000

* cited by examiner

*Primary Examiner*—Mark S. Graham
*Assistant Examiner*—Tom P Duong
(74) *Attorney, Agent, or Firm*—Parkhurst & Wendel, L.L.P.

(57) ABSTRACT

The present invention provides a cutting method of a ceramic honeycomb formed body 5 for cutting the ceramic honeycomb formed body 5 with a fine line stretched at an appropriate tension substantially at right angles to the direction of throughholes 9 thereof. The method comprises the steps of providing a cutting guide groove 10 running through the outer periphery of the ceramic honeycomb formed body substantially at right angles to the direction of throughholes 9, and putting a fine line 2 to the cutting guide groove 10, to cut the ceramic honeycomb formed body 5 only by pressing the fine line 2 against the ceramic honeycomb formed body 5. By using this cutting method, it is possible to cut a ceramic honeycomb formed body having thin partition walls of under 125 $\mu$m without causing a distortion. The possibility to reduce the cutting frequency of the fine line leads to possibility to improve the cutting efficiency.

6 Claims, 4 Drawing Sheets

CUTTING METHOD OF CERAMIC HONEYCOMB FORMED BODY

TECHNICAL FIELD

The present invention relates to a cutting method of a ceramic honeycomb formed body for cutting the ceramic honeycomb formed body substantially at right angles to the direction of throughholes.

BACKGROUND ART

A ceramic honeycomb structure used as a carrier for a waste gas purifying catalyst or the like is manufactured by forming a ceramic material containing ceramic powder into a honeycomb shape, cutting the thus formed body into appropriate lengths, and then, drying and firing the resultant lengths. It is therefore necessary to provide means for cutting a soft and easily deforming ceramic honeycomb formed body without affecting the shape. For such cutting, it is the conventional practice to impart a tension to a fine line 2 stretched between two pulleys 1 by a spring 3 and cutting the ceramic honeycomb formed body by causing reciprocation of this fine line in the longitudinal direction as shown in FIG. 5, or cutting the same by causing a fine line 2 in the course of rewinding the fine line 2 onto one of bobbins 8 by the rotation of servo motors 7 while imparting an appropriate tension by adjusting the torque of the servo motors 7 to the fine line 2 stretched between the bobbins 8 provided on the two servo motors 7 as shown in FIG. 6.

These conventional practices have a problem in that, because cutting is performed while moving the fine line 2 in the longitudinal direction, resistance upon cutting the outer periphery of thickness of the ceramic honeycomb formed body 5 causes a load in the moving direction of the fine line 2 on the work for cutting, resulting in a distortion in the ceramic honeycomb formed body 5. Particularly, partition walls of the honeycomb structure are showing a tendency toward a smaller thickness from the conventional value of about 150 $\mu$m to a range of from 50 to 125 $\mu$m or even smaller, and this leads to an increased numerical aperture of the honeycomb structure cross-section and hence to a smaller strength of the honeycomb formed body. The problem of distortion caused by cutting is thus becoming more serious than ever.

In addition to the distortion of the honeycomb formed body as a whole, deformation and collapse of the partition walls of the honeycomb structure under the downward load during cutting are becoming more serious. In order to avoid this phenomenon, it suffices to carry out cutting less strictly, but this results in a lower cutting efficiency.

Since cutting is accomplished while moving the fine line in the longitudinal direction, the fine line has a short service life, and it is necessary to frequently replace the fine line, requiring to adjust the tension every time the fine line is replaced. This seriously impairs the cutting efficiency of the ceramic honeycomb formed body.

The present invention was developed in view of these circumstances, and has an object to provide a cutting method of a ceramic honeycomb body which does not cause distortion in the ceramic honeycomb formed body and gives a cutting efficiency higher than in the conventional art.

DISCLOSURE OF INVENTION

More particularly, according to the present invention, there is provided a cutting method of a ceramic honeycomb formed body for cutting the ceramic honeycomb formed body with a fine line stretched at an appropriate tension substantially at right angles to the direction of throughholes thereof, comprising the steps of providing a cutting guide groove running through the outer periphery of the ceramic honeycomb formed body substantially at right angles to the direction of throughholes; and putting a fine line to the cutting guide groove, and cutting the ceramic honeycomb formed body only by pressing the fine line against the ceramic honeycomb formed body.

In the aforementioned cutting method, the fine line may be stretched between bobbins, and the position of the fine line used for cutting may be changed every an appropriate number of runs of cutting. Also in the above-mentioned cutting method, the cutting guide groove should preferably run through only the outer periphery. The cutting guide groove may be formed with a knife.

The aforementioned cutting method may comprise the steps of providing the cutting guide grooves at certain intervals with a knife provided in the conveying path, and cutting the ceramic honeycomb formed body with a fine line provided in the downstream of the knife in the conveying path.

The aforementioned cutting method may also comprise the steps of providing at least two cutting positions of the ceramic honeycomb formed body in the conveying path, and cutting the ceramic honeycomb formed body at a plurality of positions by means of the fine lines.

BRIEF DESCRIPTION OF THE DRAWINGS

FIG. 7(*b*) is a schematic view showing measuring positions of data in measurement of circularity.

BEST MODE OF CARRYING OUT THE INVENTION

Figure 1A:
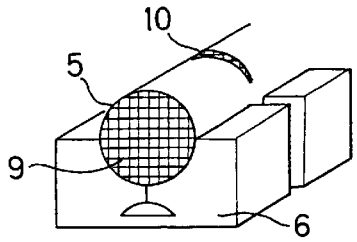
FIGS. 1(*a*) and 1(*b*) are process diagrams illustrating examples of the cutting method of the present invention.
Figure 1B:
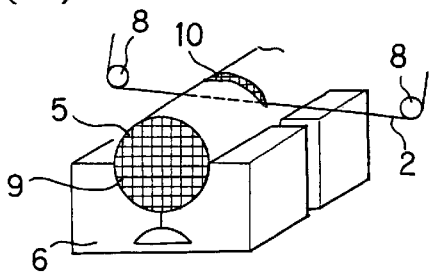

In the present invention, when cutting a ceramic honeycomb formed body substantially at right angles to the direction of throughholes thereof with a fine line stretched at an appropriate tension, a cutting guide groove 10 running through the outer periphery of the ceramic honeycomb formed body 5 substantially at right angles to the direction of the throughholes 9 thereof is first provided as shown in FIG. 1(*a*), and then, cutting is accomplished only by putting the fine line 2 to the thus provided cutting guide groove as shown in FIG. 1(*b*), and pressing the fine line 2 against the ceramic honeycomb formed body 5.

More specifically, since cutting is performed without moving the fine line 2 in the longitudinal direction, no load is applied onto the ceramic honeycomb formed body 5 in the moving direction of the fine line 2, thus permitting prevention of occurrence of distortion even when partition walls of the honeycomb 5 are thin. The fine line 2 is never moved in the longitudinal direction, and the outer periphery portion having a high cutting resistance is cut by another means. The fine line 2 has therefore a longer service life, resulting in a smaller frequency of replacement of the fine line. The cutting efficiency is therefore never impaired. This is ensured by frequently adjusting the tension of the fine line 2.

The cutting guide groove 10 is provided to permit cutting only by pressing the fine line against the ceramic honeycomb formed body without moving the fine line 2 in the longitudinal direction thereof by previously cutting the outer periphery which would cause the largest cutting resistance. The risk of crushing cells upon pressing the fine line into the honeycomb is eliminated.

There is no particular limitation on the method of providing a cutting guide groove: any of a rotary cutting edge, a laser and a water jet may be applied. The groove may also be provided with a knife. In this case, the knife should preferably have an edge width within a range of from 0.5 to 2.0 mm. With a width of under 0.5 mm, it is difficult to guide accurately the fine line into the cutting guide groove, and a width of over 2.0 mm would affect the exterior shape of the honeycomb structure. The knife material is not limited to a particular one, but any material may be used so far as it has a hardness higher than that of the honeycomb formed body. Iron, steel or super steel is particularly preferable.

Figure 2:
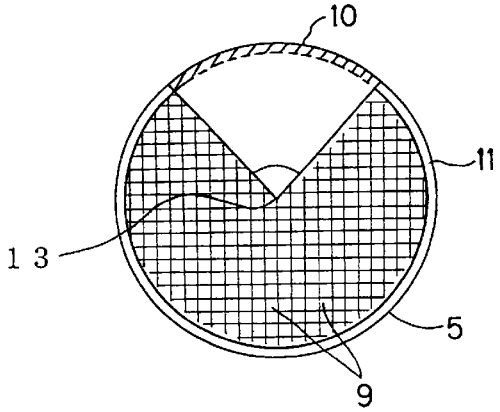
FIG. 2 is a schematic view illustrating a typical embodiment of installation of the cutting guide groove in the cutting method of the invention.

In the cutting method of the invention, as shown in FIG. 2, the cutting guide groove 10 should preferably be provided so as to run only through the outer periphery 11. When forming the cutting guide groove 10 by means of a knife or the like, cutting would be conducted by relatively moving the knife edge on the outer periphery of the honeycomb formed body. If the partition walls are simultaneously cut in such a manner, particularly when the partition walls are very thin in thickness, there is a risk of breakage of the partition walls upon cutting.

When forming the cutting guide groove by means of a knife, the cutting speed should preferably be within a range of from 20 to 150 mm/second. At a speed of under 20 mm/second, the cutting efficiency is impaired. At a speed of over 150 mm/second, on the other hand, the thickness of the partition walls may cause a distortion in the ceramic honeycomb formed body. honeycomb formed body.

In the cutting method of the invention, no particular limitation is imposed on the fine line material. Any material may be adopted so far as it suitably permits cutting of the ceramic honeycomb formed body. Among others, a piano wire, a steel wire, a fiber line of a synthetic resin fiber or carbon fiber, a wire coated with diamond, or a fine line inlaid with fine particles may be suitably applicable. The fine line should preferably have a diameter within a range of from 20 to 100 $\mu$m.

In the cutting method of the invention, the fine line 2 may be stretched between two bobbins 8 as shown in FIG. 1(*b*). In this case, a motor 7 is provided for each bobbin 8, and a tension of the fine line 2 is provided by imparting a rotational force in counter directions to the two motors, and the intensity thereof is adjusted by acting on the extent of the rotational force. From the point of view of preventing breakage of the fine line 2 caused by superannuating and thus preventing a decrease in the cutting efficiency caused by an increased efficiency of re-stretching and tension adjustment of the fine line 2, the motor may be rotated and the position of the fine line used for cutting may be changed after an appropriate number of runs of cutting. The kind of the motor is not limited so far as it permits use for the aforementioned purposes. Among others, however, a servo motor or a torque motor is suitably applicable.

In order to cut the honeycomb formed body 5 by means of the fine line 2, in this case, it is desirable to move the fine line 2 downward at a speed of up to 250 mm/second. At a speed of over 250 mm/second, the cell structure may be crushed through deformation as a result of the relative thickness of the partition walls.

The end face shape of the honeycomb formed body to be cut by the cutting method of the invention is not limited to a particular one, but a honeycomb formed body having any shape such as a circle, an ellipsoid, a square, a triangle, a pentagon or a hexagon may suitably be cut.

Figure 4:
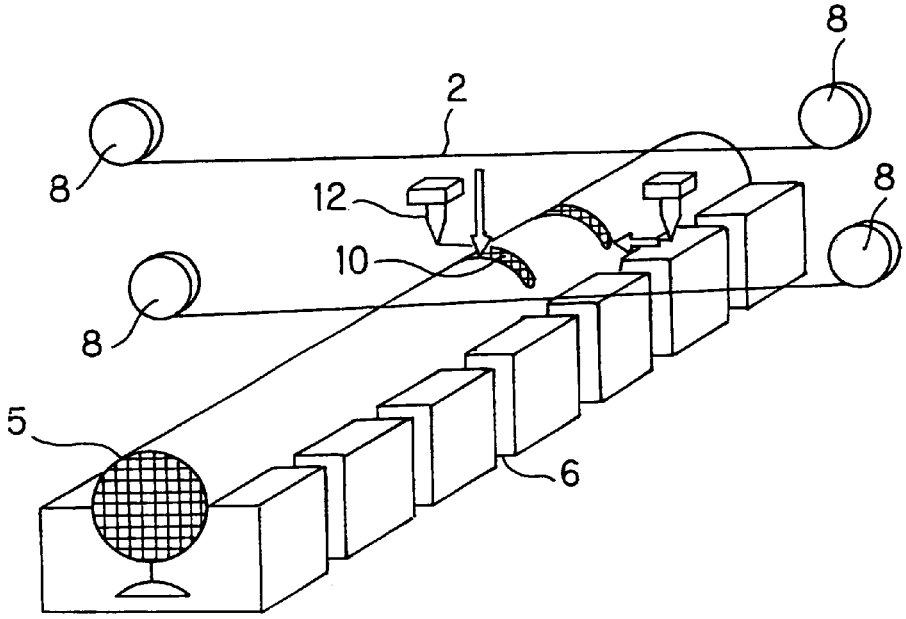
FIG. 4 is a schematic view illustrating still another embodiment of the cutting method of the invention.

In the invention, as shown in FIG. 4, it is desirable to provide at least two cutting positions on the ceramic honeycomb formed body 5 in the conveyance path, and to cut the ceramic honeycomb formed body 5 at a plurality of positions by means of the fine line 2.

As described above, there is a tendency of the partition walls of a honeycomb structure toward becoming thinner. In order to conduct cutting without causing deformation of thin partition walls, it is known that it is desirable to cut the work by means of a thinner fine line with a weaker tension. However, if cutting is carried out with a thinner fine line with a weaker tension, the fine line would have a lower strength, requiring to conduct cutting at a slower speed, thus resulting in a lower productivity.

According to the invention, therefore, a fewer cutting positions are provided at two points, and cutting efficiency is increased by synchronously carrying out cutting while a plurality of fine lines 2 are synchronized with a carriage 6, thus permitting a slower cutting without causing a decrease in productivity. By using the present invention, therefore, it would be possible to easily cope with the future tendency toward thinner partition walls of the honeycomb structure.

The present invention will now be described further in detail by means of examples with reference to the drawings. The invention is not limited to these examples.

EXAMPLE 1

After providing a cutting guide groove on the outer periphery of a ceramic honeycomb formed body, a fine line was put to the cutting guide groove, to cut the honeycomb only by pressing the fine line against the ceramic honeycomb formed body, and the distortion of the cut ceramic honeycomb formed body was measured.

Figure 3:
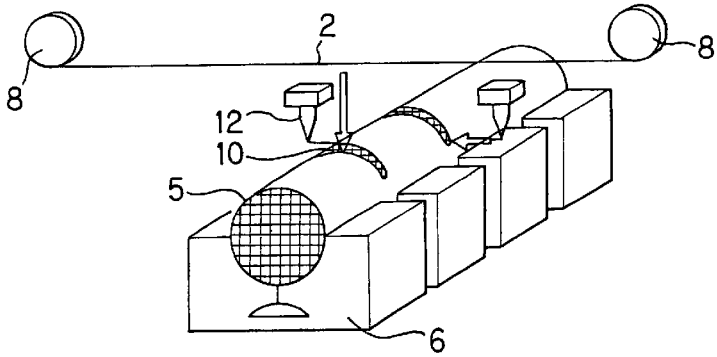
FIG. 3 is a schematic view of another embodiment of the cutting method of the invention.

The object of cutting was a ceramic honeycomb formed body firing having a circular end face of a diameter of 111.0 mm, a partition wall thickness of 120 $\mu$m, a cell pitch of 1.40 mm, and an outer periphery thickness of 0.50 mm. First, as shown in FIG. 3, cutting guide grooves 10 were formed by a knife 12 provided in a conveyance path at intervals of 220 mm on a ceramic honeycomb formed body 5 conveyed from a forming machine (not shown) through the conveyance path at a speed of 50 mm/second. Then, the ceramic honeycomb formed body 5 was cut by means of a fine line 2 provided in the downstream by 220 mm of the knife 12 in the conveyance path.

The knife 12 used had an edge width of 1.0 mm. The cutting guide grooves 10 were provided by moving this knife 12 at a speed of 75 mm/second substantially at right angles to throughholes 9 of the honeycomb 5 on the outer periphery thereof. The cutting guide groove 10 had a depth of 1 mm, i.e., equal to the thickness of the outer periphery, and a width of 1 mm. The cutting guide grooves 10 were formed, as shown in FIG. 2, so that two straight lines connecting the both ends of the cutting guide grooves 10 and the center point 13 of the circular cross-section of the honeycomb formed body 5 cross each other at an angle of 80°.

The fine line 2 was made of steel and had a diameter of 0.07 mm. The fine line 2 was stretched between bobbins 8 provided at an interval of 620 mm on two servo motors (not shown) as shown in FIG. 1(*b*). A tension of 750 gf was produced in the fine line 2 by imparting rotational force in reverse directions to the two servo motors. Cutting was carried out by moving down the fine line 2 at a speed of 200 mm/second and pressing the same against the honeycomb body 5.

Figure 7A:
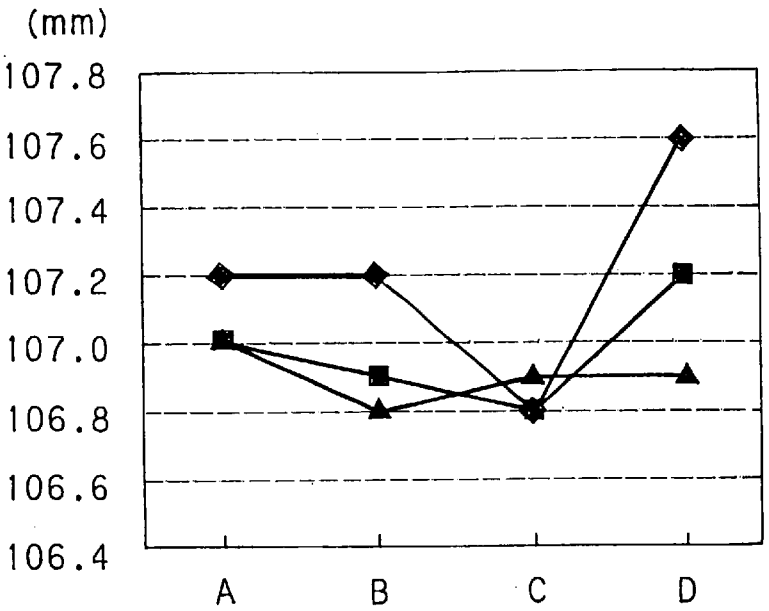
FIG. 7(*a*) is a graph showing the circularity of a ceramic honeycomb formed body cut by the invention and the conventional cutting method.
Figure 7B:
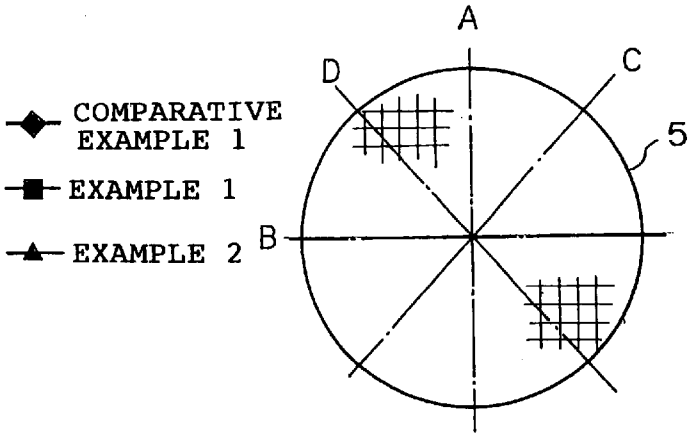

Distortion of the cut formed body was investigated by measuring circularity. Measurement of circularity was accomplished through automatic measurement by means of digital slide calipers, or the like. The measuring points are shown in FIG. 7(*b*), and the result of measurement, in FIG. 7(*a*).

EXAMPLE 2

As shown in FIG. 4, a ceramic honeycomb formed body 5 conveyed out of a forming machine (not shown) through a conveyance path at a speed of 50 mm/second was cut by first providing cutting guide grooves 10 at intervals of 220 mm by a knife 12 provided in the conveyance path, and then cutting the ceramic honeycomb formed body 5 by means of a fine line 2 provided in the downstream by 650 mm of the knife 12 in the conveyance path, and another fine line 2 provided in the downstream further by 190 mm.

The fine line 2 was made of steel and had a diameter of 0.055 mm. A tension of 500 gf was produced in the fine line 2 by imparting counter-direction rotational force to the two servo motors. Cutting was carried out by moving down the fine lines 2 at a speed of 50 mm/second and pressing the fine lines 2 against the honeycomb body 5.

The other conditions were the same as in Example 1. Distortion of the cut formed body was investigated by measuring circularity in the same manner as in Example 1.

The result is shown in FIG. 7(*a*).

COMPARATIVE EXAMPLE 1

Figure 5:
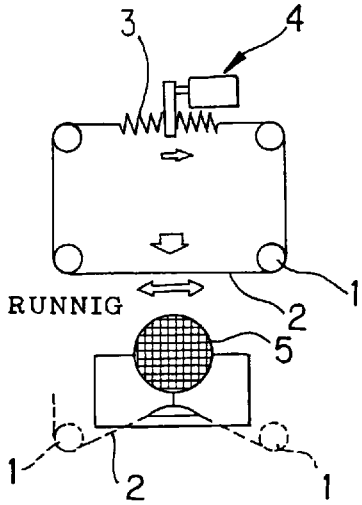
FIG. 5 is a schematic view illustrating an example of the conventional cutting method.

As shown in FIG. 5, a tension was imparted by a spring 3 to a fine line 2 stretched between two pulleys, and a ceramic honeycomb formed body 5 was cut by causing the fine line 2 to reciprocate in the longitudinal direction. Distortion of the cut honeycomb formed body was measured.

Cutting was performed by moving down at a speed of 200 mm/second the fine line 2 reciprocating at a speed of 200 mm/second against the ceramic honeycomb formed body 5 conveyed out from a forming machine through a conveyance path. The other conditions were the same as in Example 1. Distortion of the cut formed body was investigated by measuring circularity in the same manner as in Example 1. The result is shown in FIG. 7(*a*).

COMPARATIVE EXAMPLE 2

Figure 6:
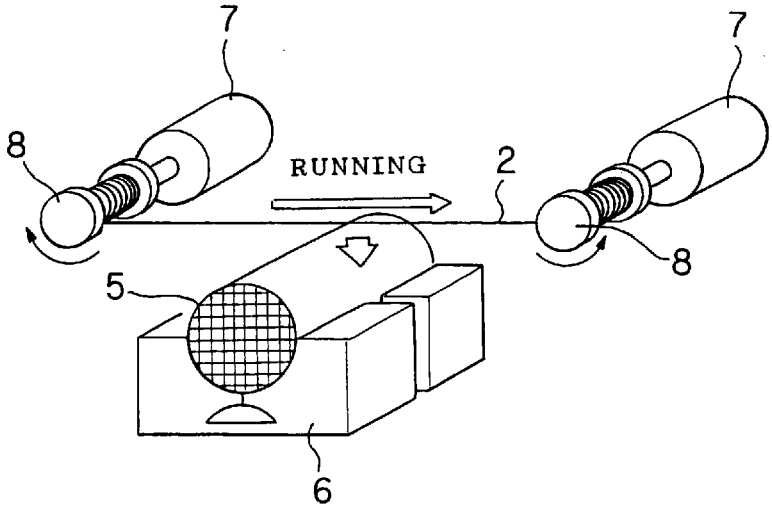
FIG. 6 is a schematic view illustrating another example of conventional cutting method.

As shown in FIG. 6, a ceramic honeycomb formed body 5 was cut in the course of rewinding a fine line 2 on a bobbin 8 by the rotation of a servo motor 7 while imparting an appropriate tension to the fine line 2 stretched between two bobbins 8 provided on two servo motors 7 by adjusting torque of the servo motors 7.

Cutting was accomplished by moving down at a speed of 100 mm/second the fine line 2 in the course of winding at a speed of 250 mm/second against the ceramic honeycomb formed body 5 conveyed out from a forming machine through a conveyance path. The other conditions were the same as in Example 1. Distortion of the cut formed body was investigated by measuring circularity in the same manner as in Example 1. The result is shown in FIG. 7(*a*).

FIG. 7(*a*) suggests that the cases of cutting by the methods of Examples 1 and 2 gave a small circularity of the cut works, whereas the cases of cutting by the method of Comparative Example 1 results in a large circularity of the cut work.

Industrial Applicability

By using the cutting method of the present invention, it is possible to cut a ceramic honeycomb formed body having a very thin partition wall as under 125 $\mu$m without causing distortion of the honeycomb, and to reduce the frequency of cutting runs of the fine line, thus permitting improvement of the cutting efficiency. The cutting frequency of the fine line can further be reduced by changing the position of the fine line used for cutting every an appropriate number of cutting runs by stretching the fine line between two bobbins, thus further improving the cutting efficiency.

Furthermore, when at least two cutting positions are provided to cut the ceramic honeycomb formed body at a plurality of positions, it is possible to conduct less strict cutting without reducing productivity. It is therefore possible to cut a honeycomb structure having a high numerical aperture of under 125 mm without causing deformation or breakage of thin partition walls. In this case where the number of cutting runs per a unit time for each cutting position becomes a half, continuous production of a period of time twice as long as in the case where there is only a single cutting position even when using a fine line of the same length.

The ceramic honeycomb formed body available by the cutting method of the invention is finished into a honeycomb structure through drying and firing. The resultant honeycomb structure is suitably applicable as a dust collecting filter or a carrier for a waste gas purifying catalyst.

What is claimed is:

1. A cutting method of a ceramic honeycomb formed body for cutting a ceramic honeycomb formed body with a fine line stretched at an appropriate tension substantially at right angles to the direction of throughholes thereof, comprising the steps of:

providing a cutting guide groove running through the outer periphery of the ceramic honeycomb formed body substantially at right angles to the direction of throughholes thereof having a depth capable of cutting through a whole thickness of the outer periphery of the ceramic body; and putting a fine line to said cutting guide groove, and cutting the ceramic honeycomb formed body only by pressing said fine line against the ceramic honeycomb formed body downwardly and not reciprocating in a longitudinal direction.

2. A cutting method of a ceramic honeycomb formed body according to claim 1, comprising the steps of stretching said fine line between bobbins, and changing the position of the fine line used for cutting after an appropriate number of runs of cutting.

3. A cutting method of a ceramic honeycomb formed body according to claim 1, wherein said cutting guide groove runs through only said outer periphery.

4. A cutting method of a ceramic honeycomb formed body according to claim 1, wherein said cutting guide groove is formed with a knife.

5. A cutting method of a ceramic honeycomb formed body according to claim 1, which comprises:

providing the ceramic honeycomb formed body conveyed through a conveyance path from a forming machine with said cutting guide grooves at certain intervals with a knife provided in said conveyance path, and cutting said ceramic honeycomb formed body with the fine line provided in the downstream of said knife in said conveyance path.

6. A cutting method of a ceramic honeycomb formed body according to claim 1, which comprises:

providing at least two cutting positions of the ceramic honeycomb formed body in said conveyance path, and cutting the ceramic honeycomb formed body at a plurality of positions by means of said fine lines.

* * * * *